US006684857B2

(12) United States Patent
Boecking

(10) Patent No.: US 6,684,857 B2
(45) Date of Patent: Feb. 3, 2004

(54) COMMON RAIL FUEL INJECTOR FOR INTERNAL COMBUSTION ENGINES, AS WELL AS A FUEL SYSTEM AND AN INTERNAL COMBUSTION ENGINE INCORPORATING THE INJECTOR

(75) Inventor: Friedrich Boecking, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 56 days.

(21) Appl. No.: 10/144,858

(22) Filed: May 15, 2002

(65) Prior Publication Data

US 2002/0185111 A1 Dec. 12, 2002

(30) Foreign Application Priority Data

May 16, 2001 (DE) ..... 101 23 775

(51) Int. Cl.[7] ..... F02M 55/02

(52) U.S. Cl. ..... 123/467; 239/96

(58) Field of Search ..... 123/467, 514, 123/447; 239/88–96

(56) References Cited

U.S. PATENT DOCUMENTS

| | | | | | |
|---|---|---|---|---|---|
| 5,622,152 | A | * | 4/1997 | Ishida | 123/446 |
| 5,711,279 | A | * | 1/1998 | Green et al. | 123/506 |
| 5,893,350 | A | * | 4/1999 | Timms | 123/467 |
| 6,367,453 | B1 | * | 4/2002 | Igashira et al. | 123/467 |
| 6,499,465 | B1 | * | 12/2002 | Mahr et al. | 123/447 |
| 6,513,497 | B1 | * | 2/2003 | Mahr et al. | 123/447 |
| 6,553,967 | B2 | * | 4/2003 | Mahr | 123/467 |

* cited by examiner

*Primary Examiner*—Thomas N. Moulis
(74) *Attorney, Agent, or Firm*—Ronald E. Greigg

(57) ABSTRACT

A fuel injection device for an internal combustion engines includes a housing with an injection end. A recess extends inside the housing contains an axially movable valve element, which cooperates with a valve seat and has a pressure surface oriented away from the injection end, which pressure surface axially delimits a control chamber. A device is provided which acts on the valve element counter to the force resultant of the pressure surface. A control valve is connected to the control chamber via a flow throttle. The control valve has at least three connections and at least two switching positions and is connected to a high-pressure fluid inlet and a low-pressure fluid outlet on the one side and be connected to the flow throttle on the other side.

17 Claims, 4 Drawing Sheets

COMMON RAIL FUEL INJECTOR FOR INTERNAL COMBUSTION ENGINES, AS WELL AS A FUEL SYSTEM AND AN INTERNAL COMBUSTION ENGINE INCORPORATING THE INJECTOR

BACKGROUND OF THE INVENTION

1. Field of the Invention

The invention relates to a fuel injection device for internal combustion engines, in particular a common rail injector, with a housing that has an injection end, with a recess provided in the housing, with at least one axially movable valve element, which is disposed in the recess and which cooperates with a valve seat, and has a pressure surface oriented away from the injection end, which pressure surface axially delimits a control chamber, with a device that acts on the valve element counter to the force resultant of the pressure surface, and with a control valve that is connected to the control chamber via a flow throttle.

2. Description of the Prior Art

A known fuel injection device of the kind described above is on the market. It is a common rail injector. In it, an axial end face of a valve needle delimits the control chamber. A sleeve part, which has an inlet throttle in its wall, delimits the control chamber radially. A housing part that contains an outlet throttle delimits the control chamber on the side opposite from the valve needle. The inlet throttle is connected to a high-pressure supply, whereas the outlet throttle is connected to a low-pressure region via a control valve. The throttle action of the inlet throttle is more powerful than that of the outlet throttle.

The normal high fluid pressure prevails against the pressure surface of the valve needle, whose force resultant points in the opposite direction from the axial end surface of the valve needle. In order to lift the valve needle up from its valve seat in the vicinity of the injection end, the pressure in the control chamber is reduced by an appropriate switching of the control valve. A sufficient pressure difference generates a resultant force that lifts the valve needle up from its valve seat.

OBJECT AND SUMMARY OF THE INVENTION

The object of the current invention is to modify a fuel injection device of the type mentioned at the beginning so that it has a particularly simple design.

This object is attained in a fuel injection device of the type mentioned at the beginning by virtue of the fact that the on-off valve has at least three connections and at least two switching positions and is connected to a high-pressure fluid inlet and a low-pressure fluid outlet on the one side and is connected to the flow throttle on the other side.

In the fuel injection device according to the invention, therefore, only one flow throttle is required. It functions as an inlet throttle in the one direction and functions as an outlet throttle in the other direction. On the whole, the fuel injection device according the invention requires fewer flow conduits, which simplifies its design and reduces its production costs. In addition, the fuel injection device designed in this way can also be embodied in a smaller form.

Advantageous modifications of the invention are also disclosed.

In a first modification, the flow throttle is embodied so that its throttle action in the direction toward the on-off valve is more powerful than in direction toward the control chamber. Therefore the control chamber empties more slowly than it refills. This in turn means that the fuel injection device opens more slowly than it closes. An opening and closing behavior of this kind is favorable for the mixture formation in the combustion chamber of the engine.

One simple possibility for embodying the directionally dependent throttle action is comprised in that the flow throttle has a trumpet-shaped enlargement at each of its ends and the curvature and/or the curvature progression of the trumpet-shaped enlargement of the one end differs from that of the other end.

It is particularly preferable if the trumpet-shaped enlargement at the end of the flow throttle oriented toward the control chamber is more sharply curved than the enlargement at the end oriented toward the control valve.

Alternatively or in addition, the flow throttle can also be embodied so that when fluid flows out of the control chamber, cavitation occurs downstream of the flow throttle. A cavitation of this kind increases the flow resistance when fluid flows out of the control chamber toward the control valve, which increases the pressure drop that occurs due to the flow throttle. This in turn reduces the pressure on the side of the control valve oriented toward the flow throttle. This consequently reduces the pressure drop that occurs due to the control valve itself, so that tolerances of the flow gap in the control valve have less of an impact. As a result, a simpler and less expensive control valve can be used.

In order to be able to generate such a cavitation, it is advantageous if the flow throttle has a conical form in the longitudinal direction, its cross-section at the end oriented toward the control chamber being smaller than at the end oriented toward the control valve.

The development of a cavitation can be intensified by the placement of a diffuser at the outlet of the flow throttle toward the control valve.

A particularly preferred embodiment is the fuel injection device in which the control valve has a piezoelectric actuator. Such a piezoelectric actuator works very rapidly.

A particularly preferred modification of the fuel injection device according to the invention is distinguished by the fact that it has at least one second flow throttle, which continuously connects the control chamber to the high-pressure fluid inlet, the throttle action of the second flow throttle being more powerful than that of the first flow throttle in a direction from the control chamber toward the control valve. With this fuel injection device, an additional machining step is in fact required in order to produce the second flow throttle, but this second flow throttle can accelerate the filling of the control chamber and can therefore considerably increase the closing speed of the valve element.

The invention also proposes that the valve element be provided with a second pressure surface, whose force resultant is directed essentially counter to the force resultant of the first pressure surface and which delimits a pressure chamber that is connected to the high-pressure fluid inlet. Therefore, with this fuel injection device according to the invention, a force resulting from the exertion of a high pressure on a pressure surface of the valve element acts on the valve element in the opening direction. This means that no mechanical elements, for example springs etc., are required here to exert the force required to lift the valve element up from the valve seat. This has a positive impact on both the production costs and the service life of the fuel injection device.

In a modification that builds on this one, the invention proposes that the pressure chamber be connected to the high-pressure fluid inlet by means of a flow conduit let into the housing and that the second flow throttle branch from this flow conduit. The production of the fluid connection of the high-pressure fluid inlet via the second flow conduit and the second flow throttle is particularly simple to achieve.

The invention also relates to a fuel system with a fuel tank, with at least one fuel injection device, which injects the fuel directly into the combustion chamber of an internal combustion engine, with at least one high-pressure fuel pump, and with a fuel accumulation line to which the fuel injection device is connected.

In order to be able to manufacture a fuel system of this kind in a manner that is less expensive and simpler on the whole, the invention proposes that the fuel injection device be embodied in the manner mentioned above.

The invention also relates to an internal combustion engine with at least one combustion chamber into which the fuel is directly injected.

In order to keep the costs for this internal combustion engine as low as possible and to simplify the production and design, the invention proposes that the internal combustion engine have a fuel system of the type mentioned above.

BRIEF DESCRIPTION OF THE DRAWINGS

The invention will be better understood and further objects and advantages thereof will become more apparent from the ensuing detailed description of preferred embodiments taken in conjunction with the drawings, in which.

DESCRIPTION OF THE PREFERRED EMBODIMENTS

Figure 1:
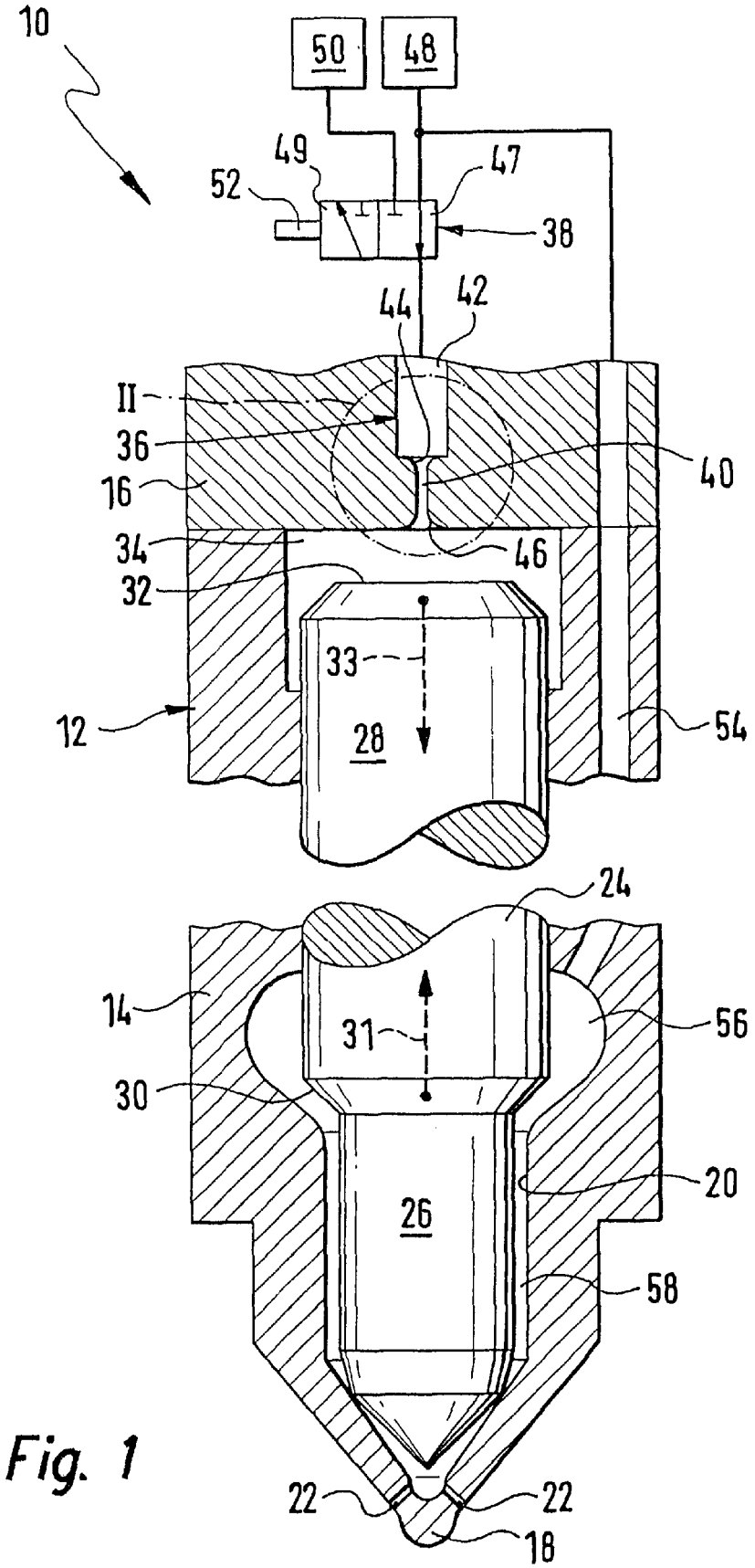
FIG. 1 shows a first exemplary embodiment of a fuel injection device for internal combustion engines.

In FIG. 1, a fuel injection device is labeled as a whole with the reference numeral 10. It is a common rail injector, which is used to directly inject highly compressed fuel into the combustion chamber of an internal combustion engine. The fuel can be diesel or gasoline. The injector 10 has a multi-part housing 12. The housing 12 includes a nozzle body 14 and an intermediary disk 16. The nozzle body 14 and the intermediary disk 16 are clamped against each other by means of a nozzle-clamping nut that is not shown in the drawing.

The bottom end of the nozzle body 14 in FIG. 1 is embodied as the injection end 18. A recess 20 extends in the longitudinal direction inside the nozzle body 14. This recess has the form of a stepped bore and ends at the injection end 18. At the injection end 18, there are several fuel outlet openings 22 that are distributed over the circumference of the injection end 18.

The recess 20 inside the nozzle body 14 contains a valve element 24. This valve element is a valve needle, which extends coaxial to the recess 20 and can move in the axial direction. The valve needle 24 cooperates with a valve seat (no reference numeral) in the vicinity of the injection end 18.

The nozzle needle has a number of sections with different diameters:

FIG. 1 shows a smaller diameter lower section 26 and a larger diameter upper section 28. The two sections 26 and 28 are separated by a step, which constitutes an oblique pressure surface 30. The larger diameter upper section 28 is axially delimited at the top by a pressure surface 32. The pressure surface 32 axially delimits a control chamber 34. Dashed arrows in FIG. 1 indicate the force resultants of the pressure surfaces 30 and 32. These arrows are labeled with the reference numerals 31 and 33.

The control chamber 34 is delimited toward the top by the intermediary disk 16. From the control chamber 34, a flow conduit 36 leads through the intermediary disk 16 to a control valve 38. The flow conduit 36 has a section with a smaller diameter, which is embodied as a flow throttle 40 (see FIG. 2). Toward the control valve 38, the flow throttle 40 feeds into a larger diameter section, which constitutes a diffuser 42.

The flow throttle 40 has a trumpet-shaped enlargement 44, 46 at each of its ends. The trumpet-shaped enlargement 44, which points toward the diffuser 42, is more sharply curved than the trumpet-shaped enlargement 46 at the end of the flow throttle 40 oriented toward the control chamber 34.

The control valve 38 is a 3/2-port on-off valve, i.e. it has three connections and two switching positions 47 and 49. As has already been explained above, it is connected to the flow conduit 36 on the one side. On the other side, it is connected to a high-pressure fluid inlet 48 and a low-pressure fluid outlet 50. A piezoelectric actuator 52 actuates the control valve 38.

The valve element of the control valve 38, which is not shown in the drawing, is generally spherical. It cooperates in the usual way with corresponding conical valve seats. However, it is also possible for there to be a control valve, which has a plate-shaped valve element, for example. The switching positions 47 and 49 of the control valve 38 are such that in the normal position 47, the flow conduit 36 is connected to the high-pressure fluid inlet 48, whereas in the actuated switching position 49, the flow conduit 36 is connected to the low-pressure fluid outlet 50.

The intermediary disk 16 and the nozzle body 14 also have an additional flow conduit 54 passing through them in the longitudinal direction of the injector 10. At its upper end in FIG. 1, this additional flow conduit 54 continuously communicates with the high-pressure fluid inlet 48. The lower end of the flow conduit 54 in FIG. 1 feeds into an annular chamber 56. Through a corresponding embodiment of the recess 20, this annular chamber 56 is formed between the nozzle body 14 and the valve needle 24, at the level of the oblique pressure surface 30. An additional annular chamber 58 extends between the nozzle body 14 and the valve needle 24, from the annular chamber 56 to the injection end 18.

The injector 10 shown in FIG. 1 functions in the following manner:

When the injector 10 is closed, the control valve 38 is in the normal position 47 shown in FIG. 1. In this instance, the full system pressure of the high-pressure fluid inlet 48 prevails in the control chamber 34; this system pressure also prevails in the flow conduit 54, in the annular chamber 56, and in the annular chamber 58. On the one hand, this pressure acts on the pressure surface 32 at the upper end of the valve needle 24. On the other hand, the pressure also acts on the oblique pressure surface 30 of the valve needle 24 at the level of the annular chamber 56. Since the pressure surface 32 at the upper end of the valve needle 24 is larger than the pressure surface 30, the corresponding force resultant (arrow 33) is more powerful than the opposite force resultant 31. The valve needle 24 is consequently pushed toward the injection end 18 of the nozzle body 14. In this position, the fuel outlet openings 22 are cut off from the annular chamber 58 so that no fuel can emerge.

In order to execute an injection with the injector 10, the control valve 38 is moved into its second switching position 49. The piezoelectric actuator 52 initiates this movement. Now, the flow conduit 36 is connected to the low-pressure fluid outlet 50. Consequently, the fuel flows from the control chamber 34, through the flow throttle 40, the diffuser 42, and the control valve 38, to the low-pressure fluid outlet 50. Consequently, the pressure drops in the control chamber 34. At the same time, however, the full system pressure still prevails in the annular chamber 56, which also acts on the oblique pressure surface 30 of the valve needle 24.

As soon as the corresponding force resultant 31 acting in the opening direction exceeds the force resultant 33 acting in the closing direction, the valve needle 24 lifts up from the valve seat in the vicinity of the injection end 18 and thus connects the fuel outlet openings 22 with the annular chamber 58. Now, fuel can emerge from the fuel outlet openings 22.

The speed of the pressure drop in the control chamber 34 is determined by the embodiment of the trumpet-shaped enlargements 44 and 46 at the respective axial ends of the flow throttle 40. The pressure drop here occurs comparatively slowly so that the valve needle 24 also opens relatively slowly. This is advantageous for the formation of a fuel spray emerging from the fuel outlet openings 22, which is optimal in terms of its combustion and emissions.

In order to terminate an injection, the piezoelectric actuator 52 is switched back to a currentless state. As a result, the control valve 38 moves back into its normal position 47, which is shown in FIG. 1. Now, the fuel flows from the high-pressure fluid inlet 48, through the control valve 38, the diffuser 42, and the flow throttle 40, back into the control chamber 34. Consequently, the pressure increases in the control chamber 34. As soon as the magnitude of the force resultant 33 exceeds the magnitude of the force resultant 31 pointing in the opposite direction, the valve needle 24 is once again pushed toward the valve seat in the vicinity of the injection end 18, consequently interrupting the connection between the fuel outlet openings 22 and the annular chamber 58.

The closing speed of the valve needle 24 is determined by the speed with which the pressure increases in the control chamber 34. This speed in turn depends on the flow velocity of the fuel through the flow throttle 44. Since the curvature of the trumpet-shaped enlargement 44 oriented toward the control valve 38 is sharper than the curvature of the trumpet-shaped enlargement 46 at the end of the flow throttle 40 oriented toward control chamber 34, the flow resistance of the fuel in the flow direction toward the control chamber 34 is less powerful than in the opposite direction.

The pressure increase in the control chamber 34 required to close the valve needle 24 therefore occurs more rapidly than the pressure drop required to open the valve needle 24. It is therefore possible, by appropriately embodying the trumpet-shaped enlargements 44 and 46, to set the opening and closing speeds of the valve needle 24 that are required to achieve a combustion that is optimal in terms of consumption and emissions. As a result, only a single flow throttle 40 is required.

Figure 3:
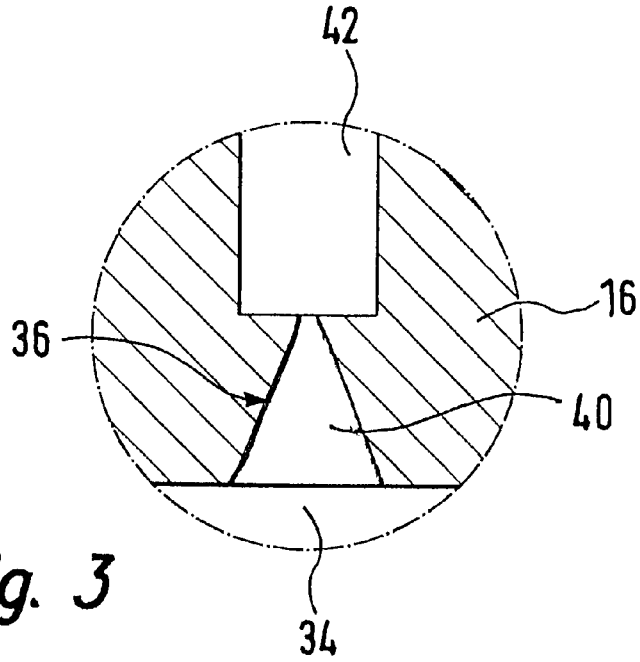
FIG. 3 is a depiction similar to FIG. 2 of an alternative embodiment of the region II of FIG. 1.

FIG. 3 shows the region of the flow throttle 40 of a second exemplary embodiment of an injector 10. Parts and regions that are functionally equivalent to parts and regions of the above-described exemplary embodiment have been provided with the same reference numerals and will not be discussed again in detail.

The essential difference between the two exemplary embodiments relates to the geometric embodiment of the flow throttle 40. Whereas in the above-described exemplary embodiment, there were trumpet-shaped enlargements at the respective axial ends of the flow throttle 40, such trumpet-shaped enlargements are not provided in the flow throttle 40 shown in FIG. 3. Instead, the flow throttle 40 has a conical form in the longitudinal direction. The cross section of the flow throttle 40 at the end oriented toward the control chamber 34 is greater than at the end oriented toward the control valve 38.

Figure 2:
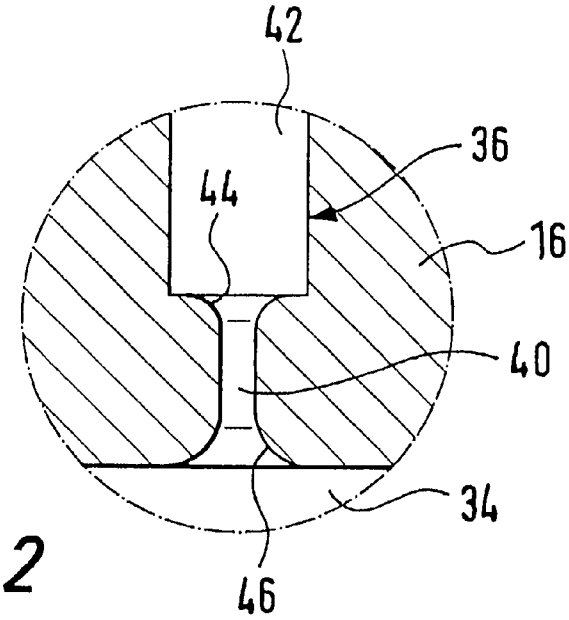
FIG. 2 shows a depiction of a detail II from FIG. 1.

As in the exemplary embodiment shown in FIGS. 1 and 2, toward the control valve 38, the flow throttle 40 feeds into the diffuser 42. When the control valve 38 is actuated so that the control chamber 34 is connected to the low-pressure fluid outlet 50, the fuel flows from the control chamber 34, through the flow throttle 40, into the diffuser 42. The abrupt cross-sectional enlargement from the flow throttle 40 into the diffuser 42 causes the pressure in the fuel to decrease abruptly so that cavitation bubbles are produced in the fuel in this region.

The occurrence of cavitation increases the flow resistance so that the emptying of the control chamber 34 and the corresponding opening motion of the valve needle 24 only occur at a relatively slow pace. In the opposite flow direction, i.e. from the control valve 38 toward the control chamber 34, such a cavitation does not occur. The fuel can consequently flow from the high-pressure fluid inlet 48 into the control chamber 34 more rapidly than in the opposite direction from the control chamber 34 toward the low-pressure fluid outlet 50.

The sharp pressure drop occurring at the transition between the flow throttle 40 and the diffuser 42 when fluid flows from the control chamber 34 toward the control valve 38 has another positive effect: because of this sharp pressure drop, a relatively low pressure already prevails on the side of the control valve 38 oriented toward the control chamber 34 when the control valve 38 is actuated. Consequently, the pressure drop occurring due to the control valve 38 is only relatively slight. In this respect, manufacturing tolerances, for example in the valve element (not shown) of the control valve 38, have only a slight influence—if any at all—on the speed with which the pressure drops in the control chamber 34.

Figure 4:
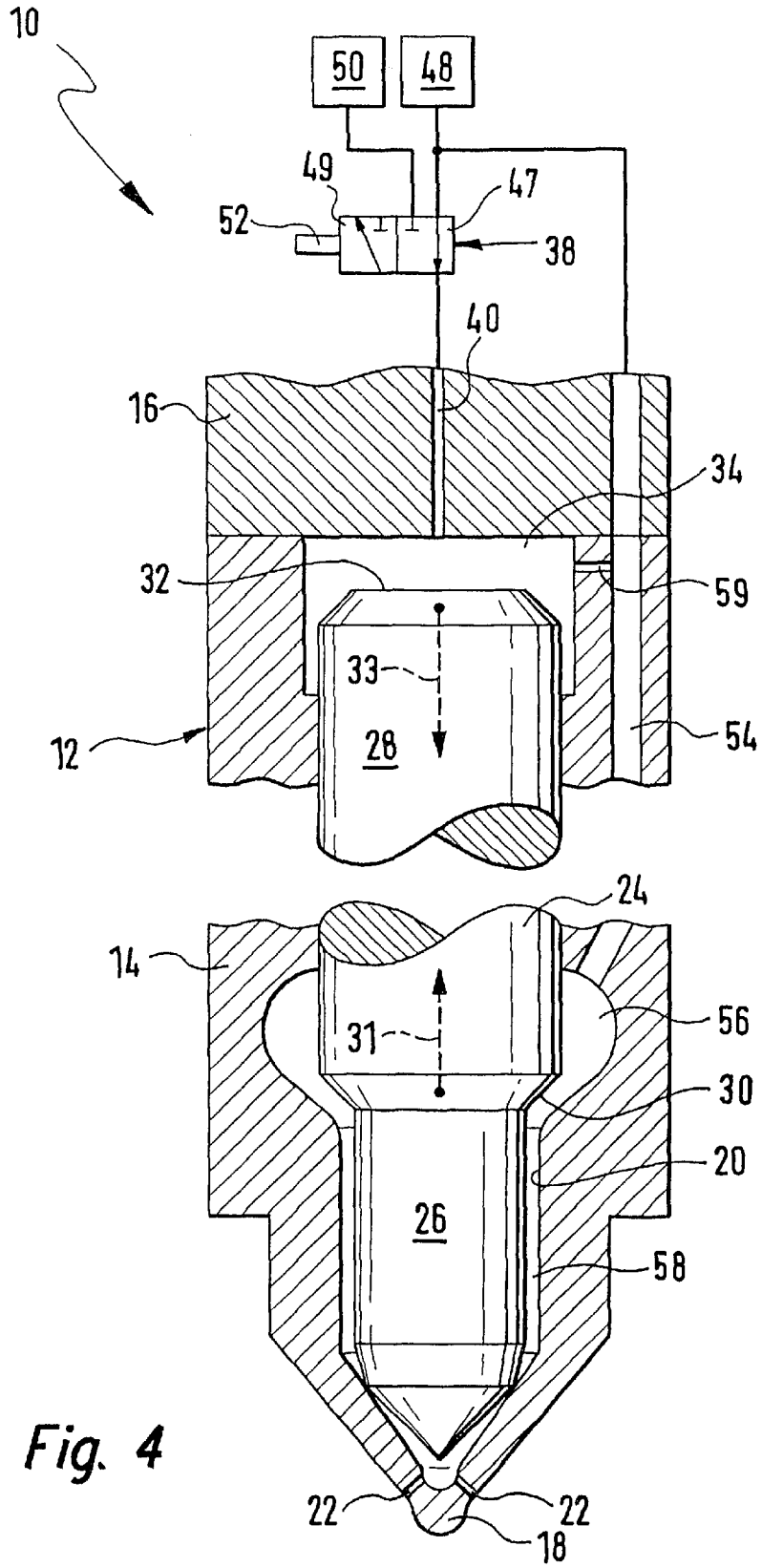
FIG. 4 is a depiction similar to FIG. 1 of a third exemplary embodiment of a fuel injection device.

FIG. 4 shows another exemplary embodiment of an injector 10. In this exemplary embodiment as well, parts and regions that are functionally equivalent to parts and regions of the preceding exemplary embodiments have been provided with the same reference numerals and will not be discussed again in detail.

In contrast to the preceding exemplary embodiments, a second flow throttle 59 branches from the second flow conduit 54. This second flow throttle 59 continuously connects the control chamber 34 to the high-pressure fluid inlet 48. The cross section and length of the second flow throttle 59 are dimensioned so that its throttle action is more powerful than that of the first flow throttle 40 in a direction from the control chamber 34 toward the control valve 38. This assures that when the control valve 38 is actuated, the fuel can flow through the first flow throttle 40 and out of the control chamber 34 more rapidly than fuel can flow through the second flow throttle 59 and back into the control chamber 34.

Another difference relates to the embodiment of the flow throttle 40. In the exemplary embodiment of an injector 10 shown in FIG. 4, this flow throttle 40 is embodied without any trumpet-shaped enlargements and is also not conical, but rather is embodied as a uniform, linear flow conduit.

In the injector 10 shown in FIG. 4, the flow throttle 40 and the flow throttle 59 are available for the filling of the control chamber 34, which is required in order to close the valve element 24. The filling of the control chamber 34 therefore occurs rapidly so that the valve element 24 is also brought very quickly from the open position into the closed position and the output of fuel from the injector 10 is terminated. Naturally, though, it is also possible to embody the flow throttle 40 in the manner shown in FIGS. 1 to 3.

Figure 5:
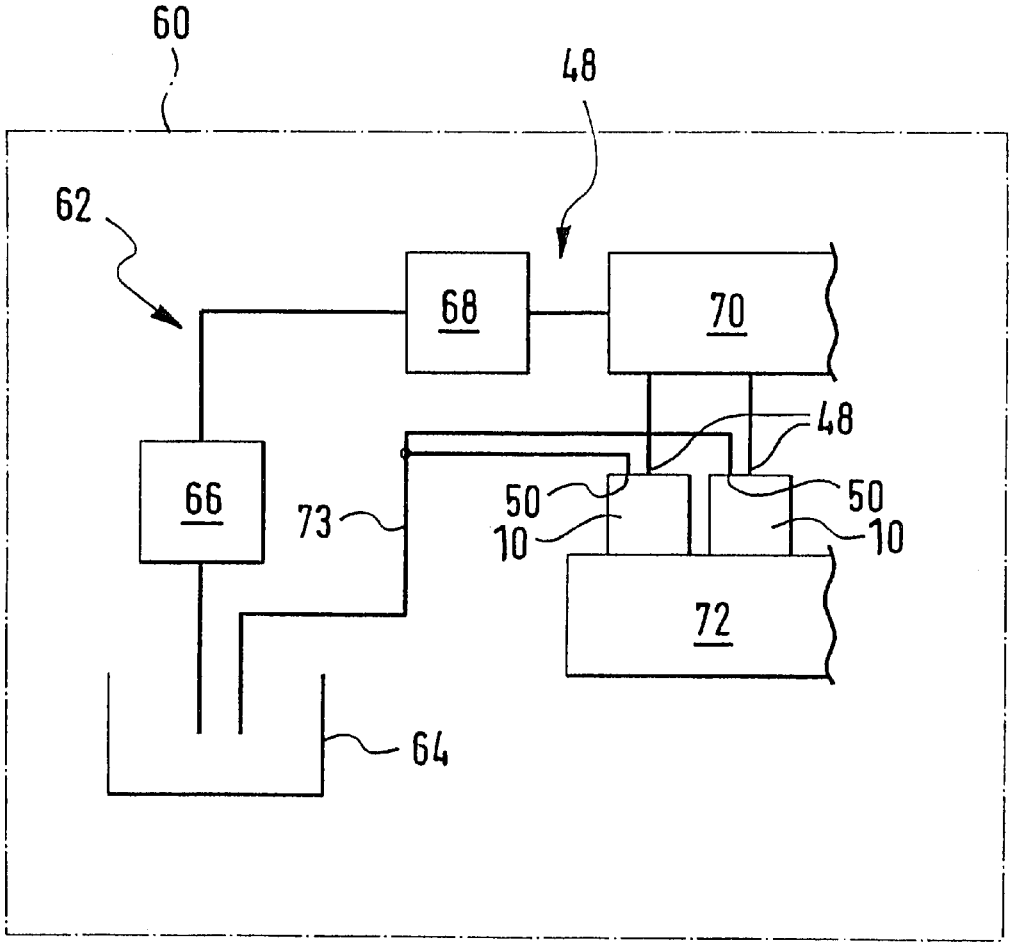
FIG. 5 is a schematic representation of an internal combustion engine with a fuel system and a number of fuel injection devices according to FIG. 1.

FIG. 5 schematically depicts an internal combustion 60, which contains a fuel system 62. This fuel system in turn has a fuel tank 64, from which an electrical low-pressure fuel pump 66 delivers fuel to a motor-driven high-pressure pump 68. From this pump, the fuel travels into a fuel accumulation line 70, which is also commonly referred to as a "rail" and leads to the above-mentioned high-pressure fluid inlet 48. The fuel accumulation line 70 is connected to a number of injectors 10, which are embodied in accordance with the FIGS. 1 and 2 or 1 and 3. The injectors 10 inject the fuel (diesel or gasoline) directly into respective combustion chambers 72. A fuel line 73 leads from the respective low-pressure outlet 50 of each injector 10 and back to the fuel tank 64.

The foregoing relates to preferred exemplary embodiments of the invention, it being understood that other variants and embodiments thereof are possible within the spirit and scope of the invention, the latter being defined by the appended claims.

I claim:

1. A common rail fuel injection device (10) for internal combustion engines (60), comprising a housing (12) having an injection end (18), a recess (20) inside the housing (12), at least one axially movable valve element (24), disposed in the recess (20) and cooperating with a valve seat, the valve element having a pressure surface (32) oriented away from the injection end (18), which pressure surface (32) axially delimits a control chamber (34), a device (30, 54, 56) that acts on the valve element (24) counter to the force resultant (33) of the pressure surface (32), and a control valve (38) that is connected to the control chamber (34) via a flow throttle (40), the control valve (38) having at least three connections and at least two switching positions and being connected to a high-pressure fluid inlet (48) and a low-pressure fluid outlet (50) on the one side and being connected to the flow throttle (40) on the other side.

2. The fuel injection device (10) according to claim 1 wherein the flow throttle (40) is embodied so that its throttle action in the direction toward the control valve (38) is more powerful than in the direction toward the control chamber (34).

3. The fuel injection device (10) according to claim 2 wherein the flow throttle (40) has a trumpet-shaped enlargement (44, 46) at each of its ends and that the curvature and/or the curvature progression of the trumpet-shaped enlargement (44) of the one end differs from that (46) of the other end.

4. The fuel injection device (10) according to claim 3 wherein the trumpet-shaped enlargement (46) at the end of the flow throttle (40) oriented toward the control chamber (34) is more sharply curved than the enlargement (44) at the end oriented toward the control valve (38).

5. The fuel injection device (10) according to claim 2 wherein the flow throttle (40) is embodied so that when fluid flows out of the control chamber (34), cavitation occurs downstream of the flow throttle (40).

6. The fuel injection device (10) according to claim 3 wherein the flow throttle (40) is embodied so that when fluid flows out of the control chamber (34), cavitation occurs downstream of the flow throttle (40).

7. The fuel injection device (10) according to claim 4 wherein the flow throttle (40) is embodied so that when fluid flows out of the control chamber (34), cavitation occurs downstream of the flow throttle (40).

8. The fuel injection device (10) according to claim 5 wherein the flow throttle (40) has a conical form in the longitudinal direction, where its cross section at the end oriented toward the control chamber (34) is greater than at the end oriented toward the control valve.

9. The fuel injection device (10) according to claim 6 wherein the flow throttle (40) has a conical form in the longitudinal direction, where its cross section at the end oriented toward the control chamber (34) is greater than at the end oriented toward the control valve.

10. The fuel injection device (10) according to claim 7 wherein the flow throttle (40) has a conical form in the longitudinal direction, where its cross section at the end oriented toward the control chamber (34) is greater than at the end oriented toward the control valve.

11. The fuel injection device (10) according to claim 1 further comprising a diffuser (42) disposed at the outlet of the flow throttle (40) toward the control valve (38).

12. The fuel injection device (10) according to claim 1 wherein the control valve (38) has a piezoelectric actuator (52).

13. The fuel injection device (10) according to claim 1 further comprising at least one second flow throttle (59) continuously connecting the control chamber (34) to the high-pressure fluid inlet (48), the throttle action of the second flow throttle (59) being more powerful than that of the first flow throttle (40) in a direction from the control chamber (34) toward the control valve (38).

14. The fuel injection device (10) according to claim 1 wherein the valve element (24) is provided with a second pressure surface (30), whose force resultant (31) is directed essentially counter to the force resultant (33) of the first pressure surface (32) and which delimits a pressure chamber (36) that is connected to the high-pressure fluid inlet (48).

15. The fuel injection device (10) according to claim 13 wherein the valve element (24) is provided with a second pressure surface (30), whose force resultant (31) is directed essentially counter to the force resultant (33) of the first pressure surface (32) and which delimits a pressure chamber (36) that is connected to the high-pressure fluid inlet (48), and wherein the pressure chamber (34) is connected to the high-pressure fluid inlet (50) by means of a flow conduit (54) let into the housing (12) and the second flow throttle (59) branches from this flow conduit (54).

16. A fuel system (62) with a fuel tank (64), with at least one fuel injection device (10), which injects the fuel directly into the combustion chamber (72) of an internal combustion engine (60), with at least one high-pressure fuel pump (68), and with a fuel accumulation line (70) to which the fuel injection device (10) is connected, the fuel injection device (10) being embodied according to claim 1.

17. An internal combustion engine (60) with at least one combustion chamber (72) into which the fuel is directly injected by a fuel system (62) as defined in claim 16.

* * * * *